US006182436B1

(12) United States Patent
Prociw et al.

(10) Patent No.: US 6,182,436 B1
(45) Date of Patent: Feb. 6, 2001

(54) PORUS MATERIAL TORCH IGNITER

(75) Inventors: Lev Alexander Prociw, Elmira; Rolando Buenafe Acolacol, Toronto, both of (CA)

(73) Assignee: Pratt & Whitney Canada Corp., Longueuil (CA)

( * ) Notice: Under 35 U.S.C. 154(b), the term of this patent shall be extended for 0 days.

(21) Appl. No.: 09/112,193

(22) Filed: Jul. 9, 1998

(51) Int. Cl.[7] ..... F02G 7/26

(52) U.S. Cl. ..... 60/39.06; 60/39.821; 60/39.826; 431/261

(58) Field of Search ..... 60/39.06, 39.821, 60/39.822, 39.823, 39.824, 39.825, 39.826, 39.827, 39.828; 431/260, 261, 267, 326, 328

(56) References Cited

U.S. PATENT DOCUMENTS 1,401,404 * 12/1921 Hoffman ..... 431/328
3,531,229 * 9/1970 Berglund ..... 431/261
3,937,007 2/1976 Kappler .
4,141,213 * 2/1979 Ross ..... 60/39.826
4,789,331 * 12/1988 Kawamura ..... 431/261
5,587,630 12/1996 Dooley .
5,673,554 * 10/1997 DeFreitas et al. ..... 60/39.821

FOREIGN PATENT DOCUMENTS 2821160 11/1979 (DE) .
1262225 2/1972 (GB) .
1377648 12/1974 (GB) .
1498135 1/1978 (GB) .

* cited by examiner

*Primary Examiner*—Charles G. Freay
(74) *Attorney, Agent, or Firm*—Jeffrey W. Astle

(57) ABSTRACT

The igniter for the combustor in a gas turbine engine includes a tubular member extending beyond the igniter tip, wherein the tubular member is a porous ceramic or high temperature nickel alloy. Fuel is fed to the bore of the tubular member by capillary action through the porous material of the tubular member and air passes through the porous tubular member to the bore.

13 Claims, 3 Drawing Sheets

PORUS MATERIAL TORCH IGNITER

BACKGROUND OF THE INVENTION

1. Field of the Invention

The present invention relates to an ignition system, and more particularly, to an injector for such ignition systems.

2. Description of the Prior Art

It has been found that dependable ignition using conventional aircraft engine ignition systems is not possible under certain situations. Of particular difficulty is to attempt to ignite a small engine at very low speed using large flow number or air blast fuel injectors. Small engines cannot produce a significant combustor pressure drop during cranking conditions and, therefore, atomization of fuel by the main fuel injector is poor.

Large flow number injectors are sized for optimum performance at full power. Fuel flows during the starting mode are not sufficient to pressurize the injectors at the starting mode flow rates and thus atomization of the fuel is inadequate, resulting in difficulty.

So-called hot starts can result if the fuel flow rate is increased at such low speed conditions. In order to solve the above problem, very small pressure atomizers, known as primary injectors, are used in association with larger secondary injectors. The small size of these primary injectors produces a greater fuel pressure at low speed, allowing for better atomization of the fuel.

The disadvantage with these small primary injectors is their tendency to become contaminated owing to the very small orifice sizes. This requires increased maintenance in the field. In addition, a second fuel manifold and fuel flow divider valves add to the complexity of the system and to the cost. At high altitude and in conditions where flame-out of the combustor might be more prevalent, requires that the primary injectors be continuously operating to inject fuel into the combustion chamber which, in fact, diverts fuel from the secondary fuel injectors to thereby hamper the cooling of the secondary injectors.

So-called torch igniters utilize a small primary injector in close proximity to the igniter, thus eliminating the requirement for a large number of small injectors. However, these primary injectors still have the problem of contamination in view of their very small orifice sizes. In order to keep the injector cool, it must be operated throughout the entire engine cycle.

Although torch igniters can solve some problems, particularly of ignition during low speed cranking conditions, their performance can still suffer at high altitudes when it is required to reignite after a flame-out, because the air flow rates and the combustor pressure drops are much greater.

SUMMARY OF THE INVENTION

It is an aim of the present invention to provide an igniter system that can ignite injectors at low speeds during a cranking mode or at high altitude conditions when fuel flow rates are low.

It is a further aim of the present invention to eliminate the need for small orifice injectors.

It is a still further aim of the present invention to provide a continuous controllable source in order that burning may occur as soon as a flammable mixture of air and fuel is supplied.

It is a yet further aim of the present invention to provide an improved fuel distribution system for an igniter that reduces the occurrence of carbon buildup and coking since small orifices or small dead spots in the conduits are not present.

A construction in accordance with the present invention comprises a fuel and air distribution means for use with an igniter in a combustor. The distribution means includes a tubular member having a bore with a first end near the igniter such that the igniter tip is within the bore at the first end and the second end projects into the combustor characterized in that the tubular member is porous material chosen from a material having high thermal tolerance whereby liquid fuel and air are fed to the tubular porous device such that the liquid fuel is retained and distributed by capillary action toward the bore of the device where the liquid fuel will vaporize and form an atomized mixture with the air.

In a more specific embodiment of the present invention, the igniter is a plasma igniter of the type described in U.S. Pat. No. 5,587,630, Dooley, issued Dec. 24, 1996.

In a still further embodiment of the present invention, the conduits supplying fuel to the porous tubular member are relatively large bore conduits, thus reducing the risks of coking.

It is a still further embodiment of the present invention whereby the tubular porous member is a circular cylinder, and the porosity of the cylinder ranges between 60 pores per inch and 200 pores per inch.

It is also contemplated that the tubular device might be spherical or frusto-conical.

A method for distributing atomized fuel to an igniter in a combustion chamber in accordance with the present invention comprises the steps of placing a tubular member having a bore with a first end near the igniter such that the igniter tip is within the bore at the first end and the second end projects into the combustor characterized in the steps of choosing the tubular member from a porous material having high thermal resistance, feeding liquid fuel to the tubular porous member such that the liquid fuel is retained and distributed by capillary action toward the bore of the device, passing air through the tubular porous member to carry the liquid fuel and vaporize the fuel and form an atomized mixture with the air.

Thus, as might be contemplated, the tubular porous member is installed to the combustor with the igniter tip just within the bore of the tubular device, and the liquid fuel is supplied to the porous tubular device where, by capillary action, the fuel will soak the porous member, but the pressurized air, also being fed to the porous tubular member, will atomize the fuel as it carries the fuel into the bore portion of the tubular device.

An advantage of the present invention is the ability to use pure air blast injectors in the combustor at low cranking speeds and high altitude conditions.

Another advantage of the present invention is the formation of a combustion cavity fed by controlled fuel and air flow rates independent of the conditions in the combustor.

Furthermore, the plasma igniter may be cooled by the air flow through the porous tube.

Flow number is defined as the fuel mass flow divided by the square of the pressure drop across the nozzle to drive that flow. The smaller the flow number, the greater the pressure drop required to flow a certain rate of fuel. It is a measure of the orifice size of the nozzle. Small flow numbers are anywhere from 0.5 to 1.5 while large flow numbers are greater than 10.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
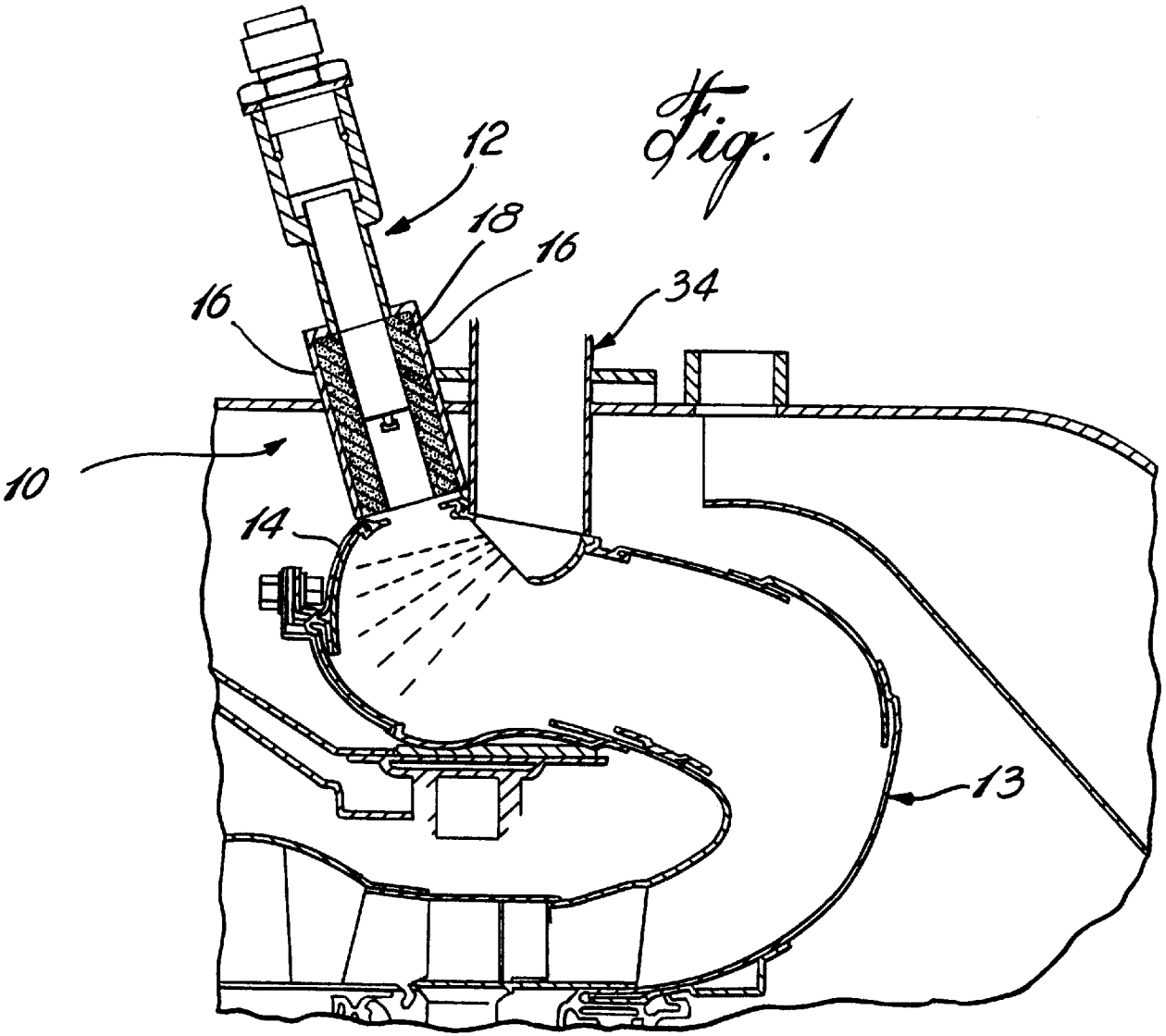
FIG. 1 is a fragmentary, axial cross-section showing a combustor of a gas turbine engine incorporating the present invention.

Referring now to FIG. 1, there is shown schematically a torch igniter 10 mounted to a combustor 13. In fact, the torch igniter includes a plasma igniter 12 in axial alignment with a cavity defined by the tubular member 18 in the housing 16 in FIG. 1. A fuel injector 34 is shown schematically next to the torch igniter 10.

Figure 2:
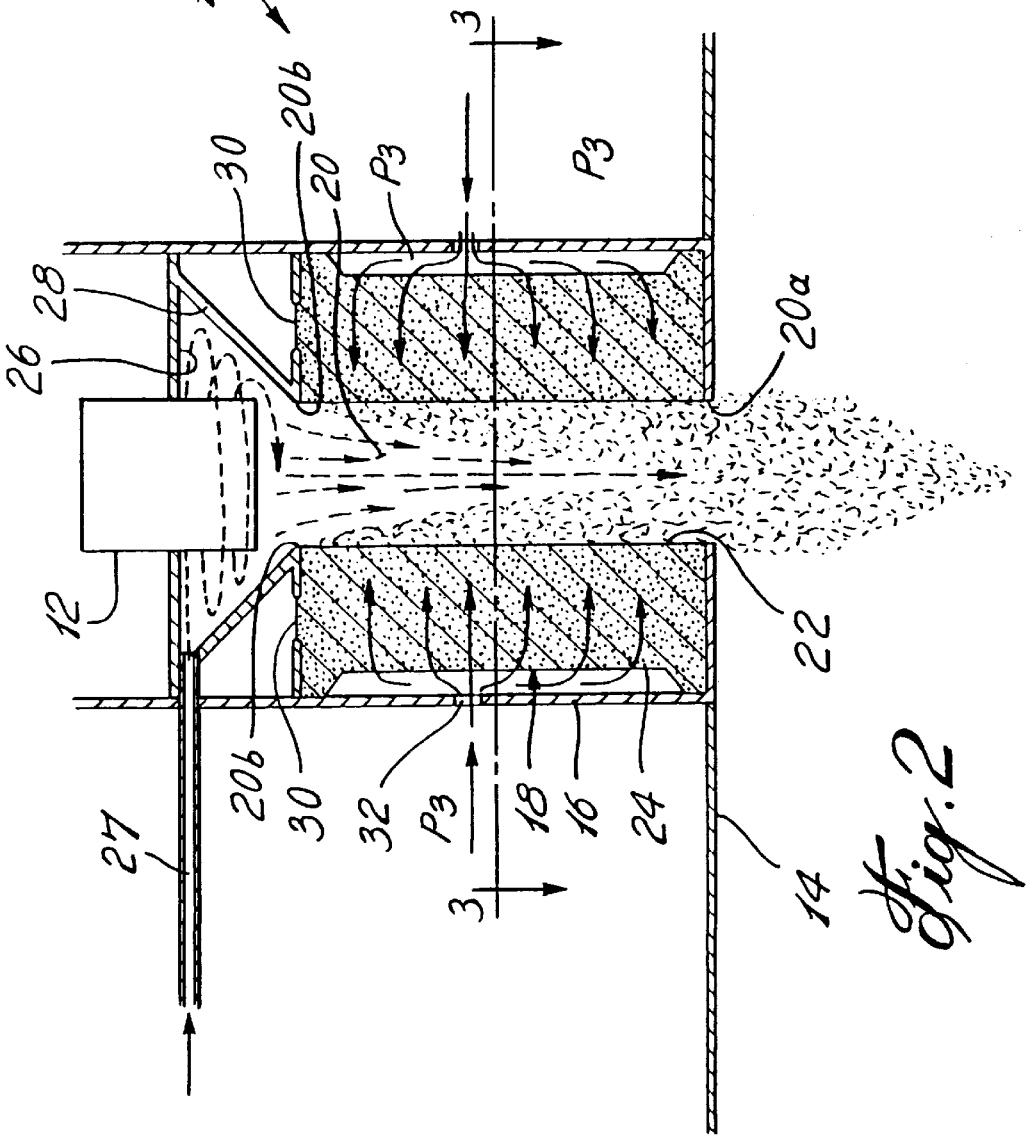
FIG. 2 is an enlarged axial cross-section of a torch igniter in accordance with the present invention.

Referring now to FIG. 2, the plasma igniter 12 is shown schematically. However, the preferred plasma igniter is in accordance with U.S. Pat. No. 5,587,630, issued Dec. 24, 1996 to Kevin A. Dooley, and assigned to the present assignee. In that patent, the plasma igniter 12 provides a continuous gaseous plasma arc across an igniter gap at the igniter tip. The description in the above-mentioned patent is incorporated herein by reference.

A tubular porous member 18 has a circular cylindrical shape in the present embodiment. The porous cylinder 18 defines an axial bore 20 defined by an inner surface 22. The cylinder has an outer recessed surface 24. The cylinder 18 is mounted in the housing 16 mounted to the exterior of the combustor wall 14. The bore 20 defines an exit opening 20*a* at the combustor wall 14.

Cylinder 18 is made of a porous ceramic or metallic material having a high thermal tolerance. The ceramic version of the cylindrical tube 18 is a high temperature silicon carbide. In the case of a metal tube, Inco 718™ may be utilized. High temperature nickel alloys are generally contemplated. A preferred range of the porous material is 100 pores per inch to 200 pores per inch. The maximum porosity would be material with 60 pores per inch. It is contemplated that the cylinder could have an increased density nearer the inner surface 22 in order to increase the capillary action.

Figure 3:
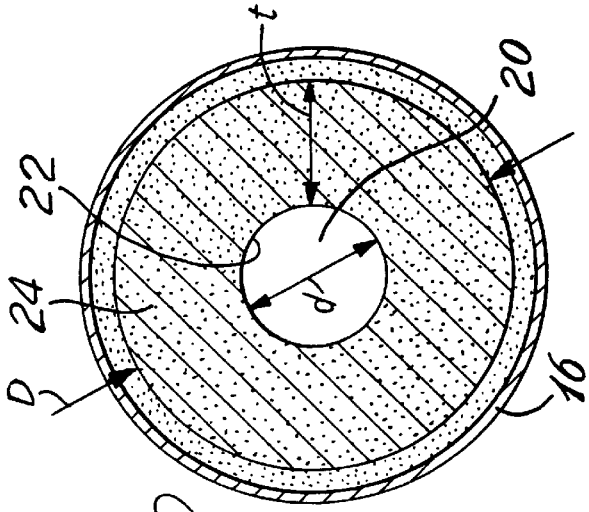
FIG. 3 is a radial cross-section taken along line 3—3 of FIG. 2.

The cylinder 18 would have a maximum length of 4 inches and a minimum length of 2 inches. A preferred cylinder 18 would have an inside diameter of no more than ½ inch and an overall axial length of 2 inches and an outside diameter of 1 inch or less. Referring to FIGS. 2 and 3, the cylinder is shown as having an outer diameter (recessed) D and the bore 20 inner diameter is d and L is the length. The thickness of the recessed cylinder wall is t. Thus, L/D~3 to 8 and preferably 4, and d/D~<0.5, preferably 0.5; also t/d~1.

Liquid fuel may be applied to the tubular cylinder 18 at inlet 30. The fuel is soaked up by capillary action within the wall of the tubular cylinder 18. Pressurized P3 air from the engine can enter the housing 16 through openings 32, thus sweeping through the wall of the tubular cylinder 18 into the cavity formed by the bore 20 while carrying fuel and atomizing it through the porous material of the wall.

Thus, it is not necessary to swirl the fuel and air mixture in order to atomize it, but it is naturally atomized as it passes through the porous material. Thus, the air entering the plenum formed by the recessed outer wall 24 and the housing 16 percolates through the porous wall of the tubular cylinder 18 and emerges into the cavity at a low velocity and laden with a quantity of vaporized fuel picked up as the air moves through the porous material.

The plasma igniter 12 is located at the end 20*b* of the tubular cylinder 18 to the housing 16 as shown. The plasma igniter 12 provides an intense local source of heat which ignites the fuel/air mixture in the cavity formed by bore 20. The expanding combustion gases escape into the combustor 13 providing a much greater source of heat for ignition of the injector 34 than would be available from the plasma igniter alone. It has been seen that such an arrangement produces ignition with pure air blast fuel injectors at very low fuel pressure.

Although continuous plasma igniters are preferred, the arrangement would also provide successful ignition with conventional intermittent igniters.

It has also been noted that once heat from the gases in the cavity is imposed on the inner surface 22, the fuel begins to evaporate at an increased rate. The evaporation from the surface 22 pulls more fuel from the porous wall to the surface 22 by capillary action while air flow continues to percolate through the porous material. There is a tendency for the fuel and air to premix and result in a continuous blue flame which continues to burn even after the plasma source is shut off, and it stops once the fuel is exhausted.

A continuous flow of air through the tubular cylinder 18 keeps the porous material cool despite the presence of the flame. As the air temperature increases, the remainder of the fuel is evaporated, thus completely drying the tube for the remainder of the cycle thereof. The continuous air flow in the remote location of the igniter helps to protect the igniter from the harsh conditions of the combustion chamber. Low air flow rates prevent a major disruption to the main combustor gas path.

A conical cavity 26 is formed with conical wall 28 in the base of the housing, terminating at the end 20*b* of bore 20, and is included to prevent the submergence of the igniter with liquid fuel. Air injected tangentially into the cavity 26 blows fuel out of the base. The swirling action helps keep liquid fuel away from the plasma surface while attracting vapor into the recirculation zone formed by bore 20. This can aid in ignition and in stabilizing the flame in the area. Air from the auxiliary external air supply is preferable in controlling the processes in the base cavity.

Figure 4A:
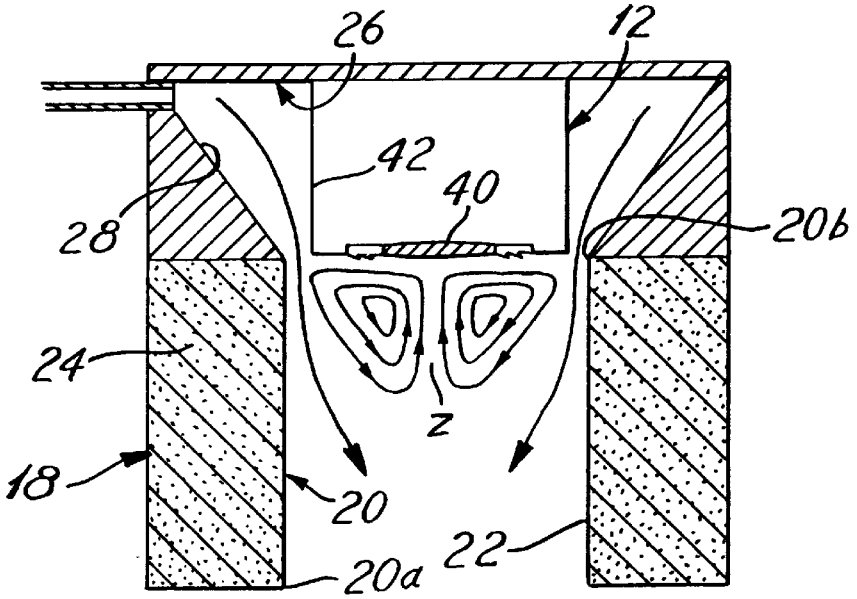
FIG. 4*a* is a schematic view of the torch igniter shown in FIG. 2 and showing some detail of the plasma electrode.
Figure 4B:
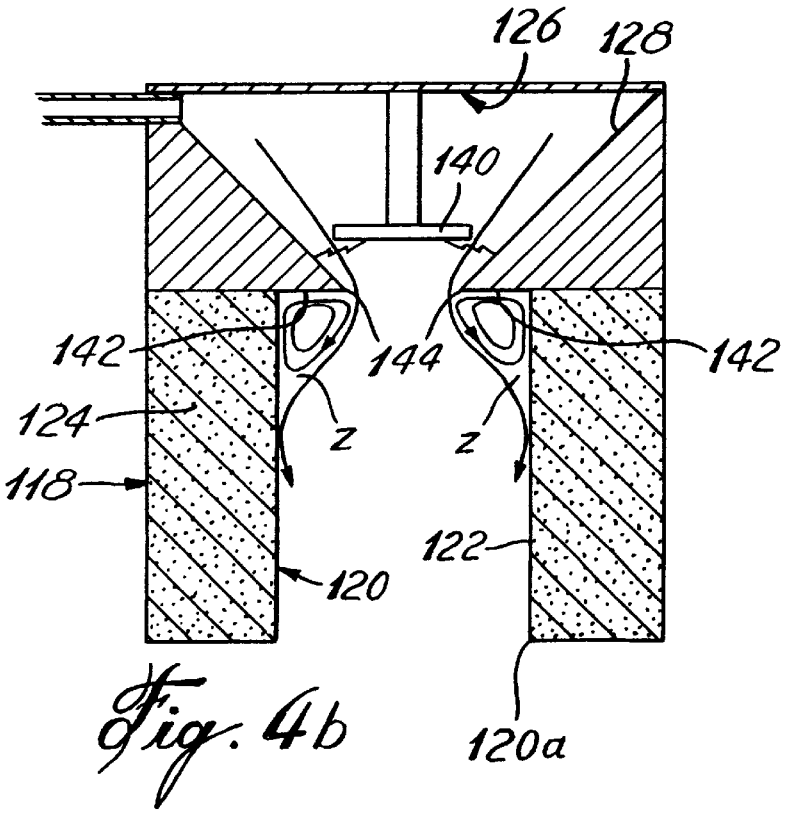
FIG. 4*b* is a schematic view of another embodiment of the igniter showing a different plasma electrode configuration.

FIGS. 4*a* and 4*b* illustrate in more detail the various arrangements that can be made to maximize the performance of the igniters. For instance, in FIG. 4*a*, the air and fuel is injected below the surface of the igniter central electrode 40 and is swirled to produce a recirculation zone Z within the bore 20 and over the igniter electrode. The plasma occurs between the casing 42, of the electrode 12, and the central electrode 40.

The reference numerals in FIG. 4*b* correspond to similar elements in FIG. 4*a* but have been increased by 100. In this embodiment, the opening 144, formed by the base, has been reduced, thereby producing a step 142. The air and fuel, in this case, entered the recirculation zone defined by the bore 120 through the opening 144. Swirling and mixing was, therefore, induced on the so-formed step 142. The plasma is observed between the electrode disc 140 and the wall 128 of the base.

The capillary pressure developed in the porous material is controlled by the pore size. The smaller the pore size, the higher the capillary pressure. The capillary pressure determines the fuel feed rate developed during the ignition sequences as well as controlling the quantity of air flowing through the porous material. Typically, the capillary pressure is very nearly the same as the pressure drop across the combustor during the start sequence. This helps restrict air flow prior to ignition while allowing it to flow more freely once ignition is achieved.

It is contemplated that fuel channels can be drilled in the porous material for rapid delivery of fuel during starts. Fuel flows through these channels and would quickly saturate the entire porous wall. Another improvement which has been contemplated is to heat the porous material in order to preheat the fuel retained in the porous material to promote faster ignition over a wider range. Additionally, catalytic surface materials can be applied to enhance combustion reactions.

We claim:

1. In an igniter for a combustor in a gas turbine engine, a fuel and air distribution means comprising a tubular member having an axial bore with a first end near the igniter such that the igniter tip is at the first end of the bore and the second end of the tubular member and bore communicates with the combustor, the tubular member is a porous material chosen from a material having a high thermal tolerance, a cavity defined behind the igniter tip relative to the axial bore and means are provided for supplying air to the cavity, a casing defining a plenum surrounding a portion of the tubular member and an air inlet for communicating high pressure air within the plenum, a fuel inlet to feed fuel to the tubular porous member such that the liquid fuel is retained and distributed by capillary action towards the axial bore of the tubular member where the liquid fuel will vaporize to form an atomized mixture and the high pressure air will serve to cool and dry the tubular porous member of fuel.

2. A fuel and air distribution device as defined in claim 1, wherein the porous tubular member has a porosity within the range of between 60 pores per inch and 200 pores per inch.

3. A fuel and air distribution device as defined in claim 2, wherein the range is between 100 pores per inch and 200 pores per inch.

4. A fuel and air distribution device as defined in claim 1, wherein the material of the tubular member is chosen from one of a high temperature ceramic and a high temperature nickel alloy.

5. A fuel and air distribution device as defined in claim 4, wherein the material is a ceramic made of silicon carbide.

6. A fuel and air distribution device as defined in claim 4, wherein the nickel alloy is Inco 718.

7. A fuel and air distribution device as defined in claim 1, wherein L/D~3 to 8 and d/D~<0.5 and t/d~1 where L is the axial length of the tubular member, D is the outer diameter, d is the inner diameter, and t is the radial thickness thereof.

8. A fuel and air distribution device as defined in claim 7, wherein L/D is 4 and d/D is 0.5.

9. A fuel and air distribution device as defined in claim 7, wherein the axial length of the tubular member is between 2 and 4 inches and the bore inside diameter is no more than 0.5 inch.

10. A fuel and air distribution device as defined in claim 1, wherein the igniter is a continuous gaseous plasma igniter.

11. An igniter as defined in claim 1, wherein the tubular member is mounted in a housing to the wall of a combustor and the housing defines an opening with the combustor wall coincident with the axial bore of the tubular device, the igniter tip including a continuous gaseous plasma igniter mounted at the other end of the housing and axially aligned with the axial bore, said cavity formed upstream of the tubular member within the housing and surrounding the continuous gaseous plasma igniter and an auxiliary air inlet at the cavity for providing air circulation within the cavity.

12. An igniter as defined in claim 11, wherein the housing includes a wall defining the cavity which has a cone shape with an opening at the apex of the cone-shaped cavity, the cone-shaped cavity surrounding the plasma igniter which is in the form of a plasma electrode, the opening having a diameter smaller than the diameter of the axial bore of the tubular member so that a step is formed downstream of the opening coincident with the first end of the bore so as to provide a fuel and air recirculation zone at the step.

13. A method for distributing atomized fuel to an igniter in a combustion chamber comprising the steps of placing a tubular member having an axial bore with a first end near the igniter such that an igniter tip is aligned with the bore at the first end and the second end communicates with the combustor, choosing the tubular member from a porous material having high thermal resistance, feeding liquid fuel to the tubular porous member, supplying high pressure air to the tubular porous member to create a pressure differential at the tubular porous member such that the liquid fuel is distributed by capillary action toward the axial bore to carry the liquid fuel and vaporize the fuel and form an atomized mixture with the air supplying air in a cavity behind behind the igniter tip relative to the tubular member to prevent the igniter tip from being submerged in fuel.

* * * * *